US010549413B2

(12) United States Patent
Chien et al.

(10) Patent No.: US 10,549,413 B2
(45) Date of Patent: Feb. 4, 2020

(54) RETURN DEVICE

(71) Applicant: BASSO INDUSTRY CORP., Taichung (TW)

(72) Inventors: Chia-Yu Chien, Taichung (TW); Cheng-En Tsai, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 198 days.

(21) Appl. No.: 15/872,159

(22) Filed: Jan. 16, 2018

(65) Prior Publication Data

US 2019/0022843 A1 Jan. 24, 2019

(30) Foreign Application Priority Data

Jan. 18, 2017 (TW) ..... 106101657 A

(51) Int. Cl.

| | |
|---|---|
| ***B25C 1/06*** | (2006.01) |
| ***B25C 1/04*** | (2006.01) |
| ***B25C 1/00*** | (2006.01) |
| *B25C 5/15* | (2006.01) |

(52) U.S. Cl.

CPC ..... *B25C 1/06* (2013.01); *B25C 1/001* (2013.01); *B25C 1/04* (2013.01); *B25C 1/008* (2013.01); *B25C 5/15* (2013.01)

(58) Field of Classification Search

CPC .. B25C 1/00; B25C 1/04; B25C 1/041; B25C 1/047; B25C 1/008; B25C 1/06; B25C 5/10; B25C 5/15; B25C 5/13

USPC ..... 227/8, 131, 130, 146, 129, 133, 120; 173/121, 162.1, 210, 204

See application file for complete search history.

(56) References Cited

U.S. PATENT DOCUMENTS 4,215,808 A * 8/1980 Sollberger ..... B25C 1/041 173/204

4,964,558 A 10/1990 Crutcher et al.

(Continued)

FOREIGN PATENT DOCUMENTS

JP H033782 A 1/1991

TW I445601 B 7/2014

(Continued)

OTHER PUBLICATIONS

Search Report issued to European counterpart application No. 18152076.8 by the EPO dated Aug. 29, 2018.

(Continued)

*Primary Examiner* — Scott A Smith

(74) *Attorney, Agent, or Firm* — Burris Law, PLLC

(57) ABSTRACT

A return device includes a return wheel unit adapted to be mounted to a gun body of a fastening tool, and including a return wheel that is movable between a free position, where the return wheel is not in contact with an impact member of the fastening tool, and a return position, where the impact member is at a strike position and is not contact with a rotatable flywheel of the fastening tool, and where the return wheel is in contact with the flywheel and the impact member such that, when the flywheel rotates in a first rotational direction, the return wheel is driven by the flywheel to rotate in a second rotational direction opposite to the first rotational direction, and moves the impact member from the strike position to a standby position.

9 Claims, 12 Drawing Sheets

(56) References Cited

U.S. PATENT DOCUMENTS

| | | | | |
|---|---|---|---|---|
| 6,971,567 | B1 * | 12/2005 | Cannaliato | B25C 1/06 173/1 |
| 6,997,367 | B2 * | 2/2006 | Hu | B25C 1/06 173/202 |
| 8,511,532 | B2 * | 8/2013 | Chien | B25C 1/06 227/120 |
| 8,763,874 | B2 * | 7/2014 | McCardle | B25C 1/047 227/129 |
| 9,539,714 | B1 * | 1/2017 | Pedicini | B25C 1/06 |
| 9,868,196 | B2 * | 1/2018 | Chien | B25C 1/047 |
| 10,173,310 | B2 * | 1/2019 | Wyler | B25C 1/06 |
| 2002/0104869 | A1 * | 8/2002 | Garvis | B25C 1/06 227/138 |
| 2006/0180631 | A1 * | 8/2006 | Pedicini | B25C 1/06 227/130 |
| 2006/0261126 | A1 | 11/2006 | Schiestl | |
| 2007/0210133 | A1 * | 9/2007 | Oda | B25C 1/06 227/131 |
| 2009/0090759 | A1 * | 4/2009 | Leimbach | B25C 1/047 227/10 |
| 2009/0294504 | A1 * | 12/2009 | Kunz | B25C 1/06 227/8 |
| 2015/0352702 | A1 | 12/2015 | Chien | |

FOREIGN PATENT DOCUMENTS

| | | |
|---|---|---|
| TW | M482482 U | 7/2014 |
| TW | M513764 U | 12/2015 |

OTHER PUBLICATIONS

Office Action issued to Japanese counterpart application No. 2018-005505 by the JPO dated Mar. 11, 2019.

* cited by examiner

RETURN DEVICE

CROSS-REFERENCE TO RELATED APPLICATION

This application claims priority of Taiwanese Patent Application No. 106101657, filed on Jan. 18, 2017.

FIELD

The disclosure relates to a return device, and more particularly to a return device adapted for use in a fastening tool, and disposed for returning an impact member from a strike position to a standby position after a nail striking operation is completed.

BACKGROUND

Each of conventional electric nail guns disclosed in Taiwanese patent Nos. M513761, I445601 and M482482 has a resilient member disposed for returning an impact member to a standby position after a nail striking operation is completed.

For each of the conventional electric nail guns, the resilient member may be an elastic rubber or a spring. However, since the resilient member is stretched during the nail striking operation, and provides a resilient force to return the impact member to the standby position, the resilient member may suffer from elastic fatigue problem after having been stretched for many times. As a result, the service life of the resilient member is short and the resilient force of the resilient member is gradually decreased.

In addition, during the nail striking operation, since the resilient member is stretched and provides the resilient pull force in a direction which is opposite to a moving direction of the impact member, the kinetic energy of the nail striking operation is decreased.

SUMMARY

Therefore, the object of the disclosure is to provide a return device that can greatly improve the smoothness and the output kinetic energy of a nail striking operation.

According to the disclosure, the return device is adapted for use in a fastening tool. The fastening tool includes a gun body, an electrically rotatable flywheel mounted rotatably to the gun body, and an impact member contactable with the flywheel, and movable between a standby position, where the impact member is close to a rear end portion of the gun body, and a strike position, where the impact member is close to a front end portion of the gun body. The return device includes a return wheel unit, and a driving unit. The return wheel unit is adapted to be mounted to the gun body, and includes a return wheel movable between a free position, where the return wheel is not in contact with the impact member, and a return position, where the impact member is at the strike position and is not contact with the flywheel, and where the return wheel is in contact with the flywheel and the impact member such that, when the flywheel rotates in a first rotational direction, the return wheel is driven by the flywheel to rotate in a second rotational direction which is opposite to the first rotational direction, and moves the impact member from the strike position to the standby position. The driving unit is adapted to be mounted to the gun body, and drives the movement of the return wheel between the free position and the return position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
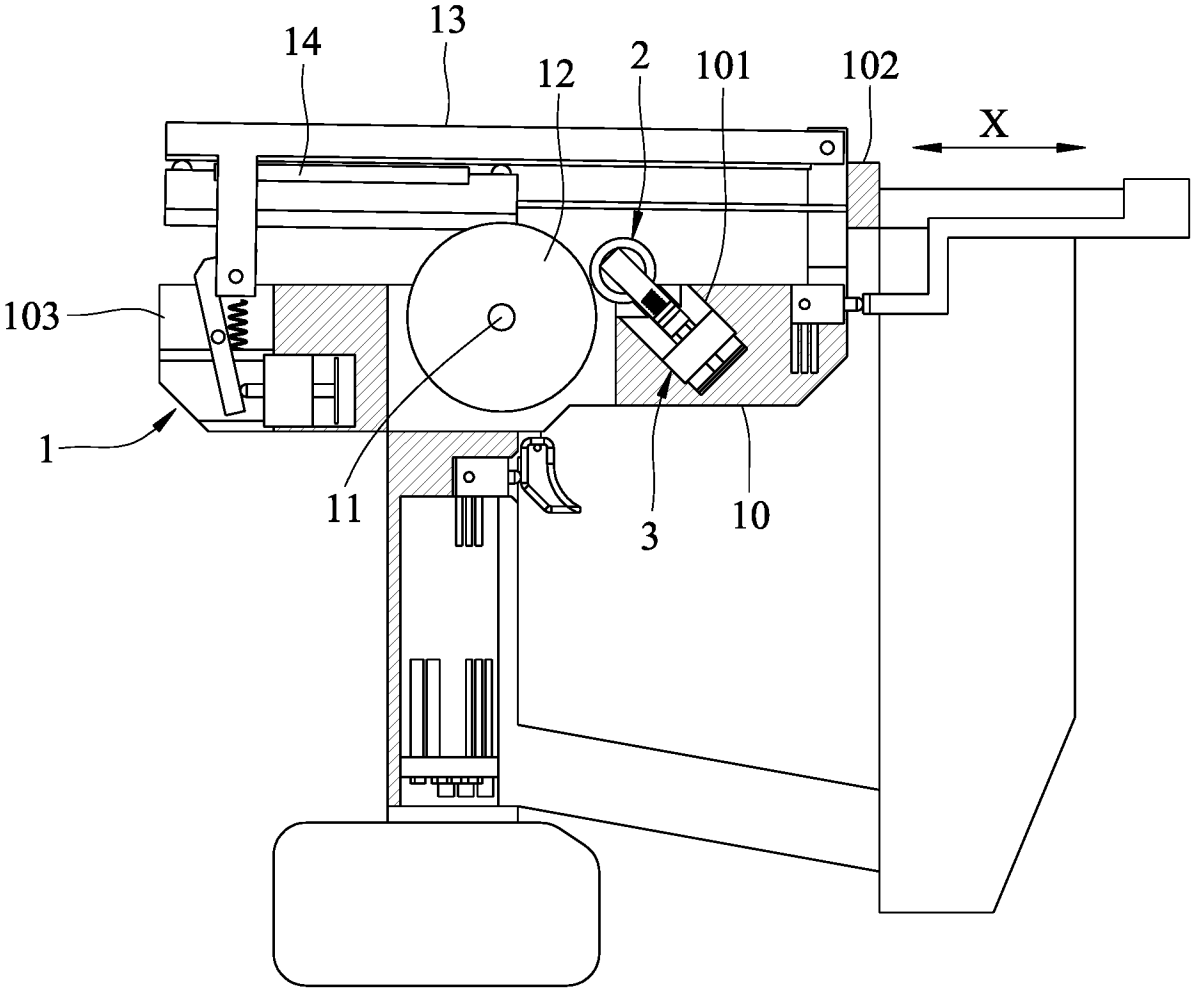
FIG. 1 is a partially sectional side view illustrating a first embodiment of a return device according to the disclosure, and illustrating that the first embodiment is adapted to be mounted to a fastening tool.

Before the disclosure is de scribed in greater detail, it should be noted that where considered appropriate, reference numerals or terminal portions of reference numerals have been repeated among the figures to indicate corresponding or analogous elements, which may optionally have similar characteristics.

Figure 2:
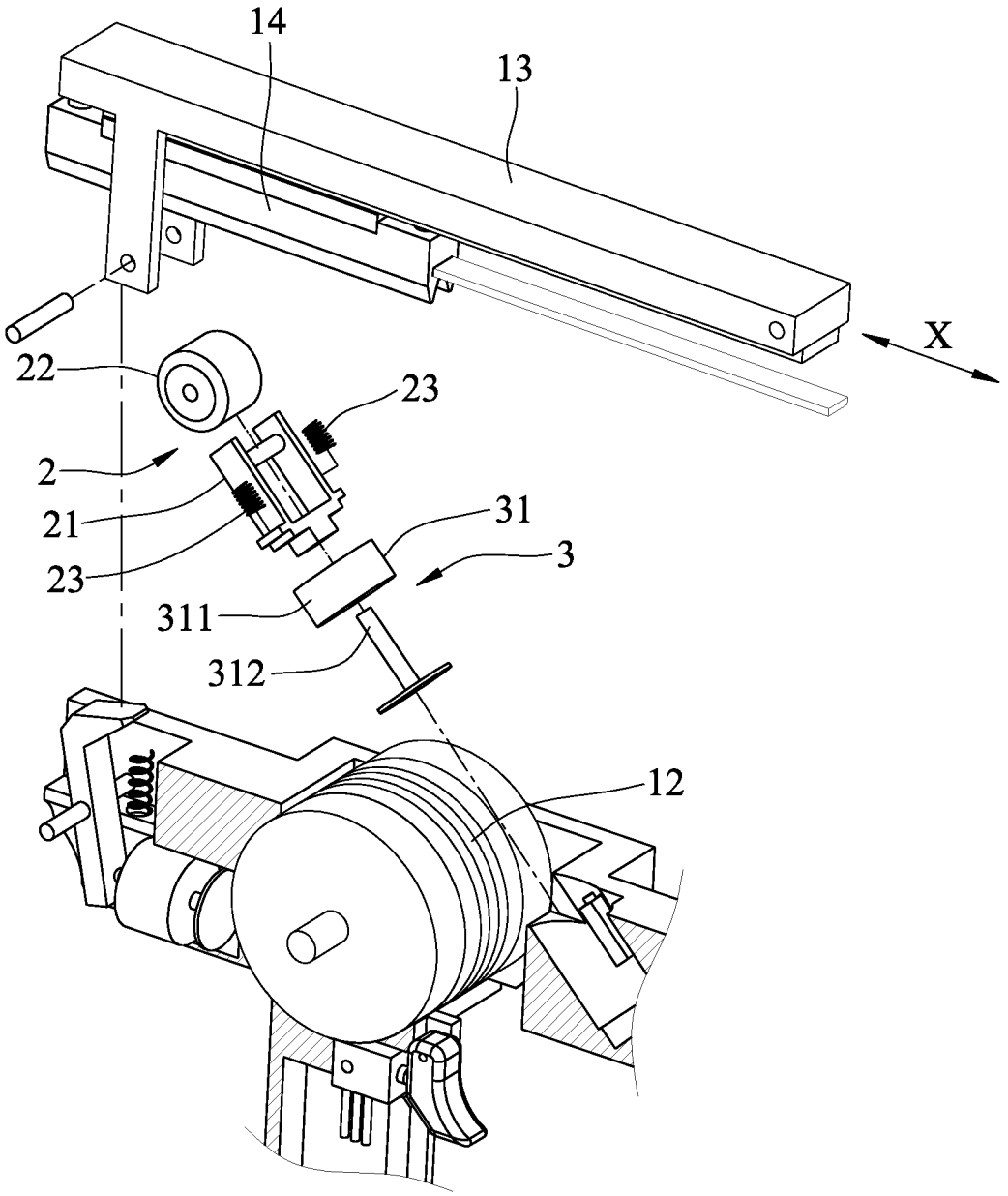
FIG. 2 is a fragmentary and partially exploded perspective view of the first embodiment, illustrating a wheel support of the first embodiment.
Figure 3:
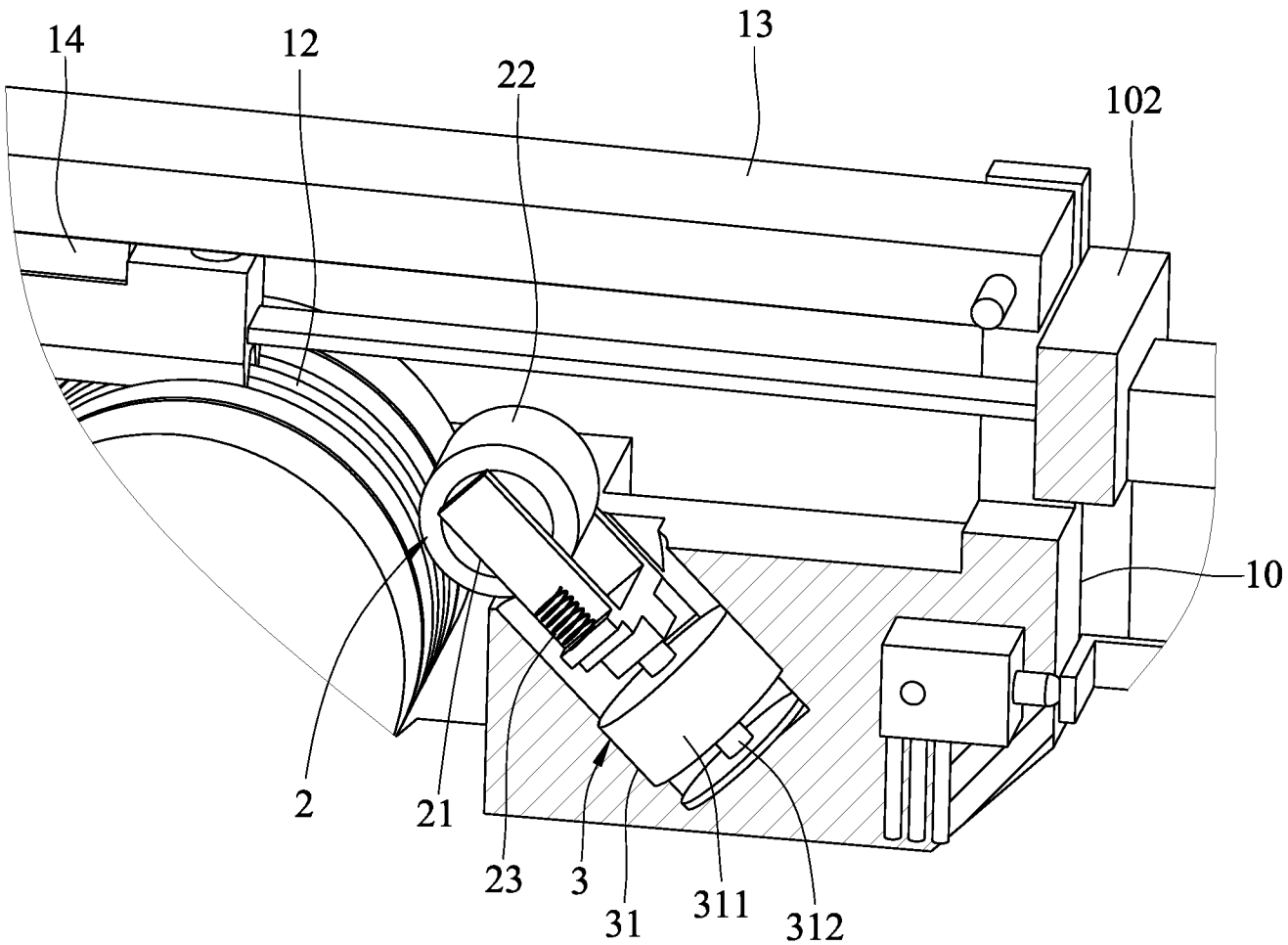
FIG. 3 is a fragmentary and partially sectional perspective view of the first embodiment, illustrating the wheel support of the first embodiment.

Referring to FIGS. 1 to 3, the first embodiment of a return device according to the disclosure is adapted for use in a fastening tool 1. The fastening tool 1 includes a gun body 10, a central shaft 11 mounted to the gun body 10, an electrically rotatable flywheel 12 rotatably mounted to the gun body 10, an arm 13 pivotally mounted to the gun body 10, and an impact member 14 contactable with the flywheel 12 as a result of movement of the arm 13 toward the flywheel 12. The gun body 10 has a first channel 101 opening toward the flywheel 12 and the impact member 14, a front end portion 102, and a rear end portion 103 which is opposite to the front end portion 102.

The impact member 14 is movable in a longitudinal direction (X) of the arm 13 by virtue of a throwing force of the flywheel 12 between a standby position, where the impact member 14 is close to the rear end portion 103 of the gun body 10, and a strike position, where the impact member 14 is close to the front end portion 102 of the gun body 10.

The return device includes a return wheel unit 2 and a driving unit 3.

Figure 4:
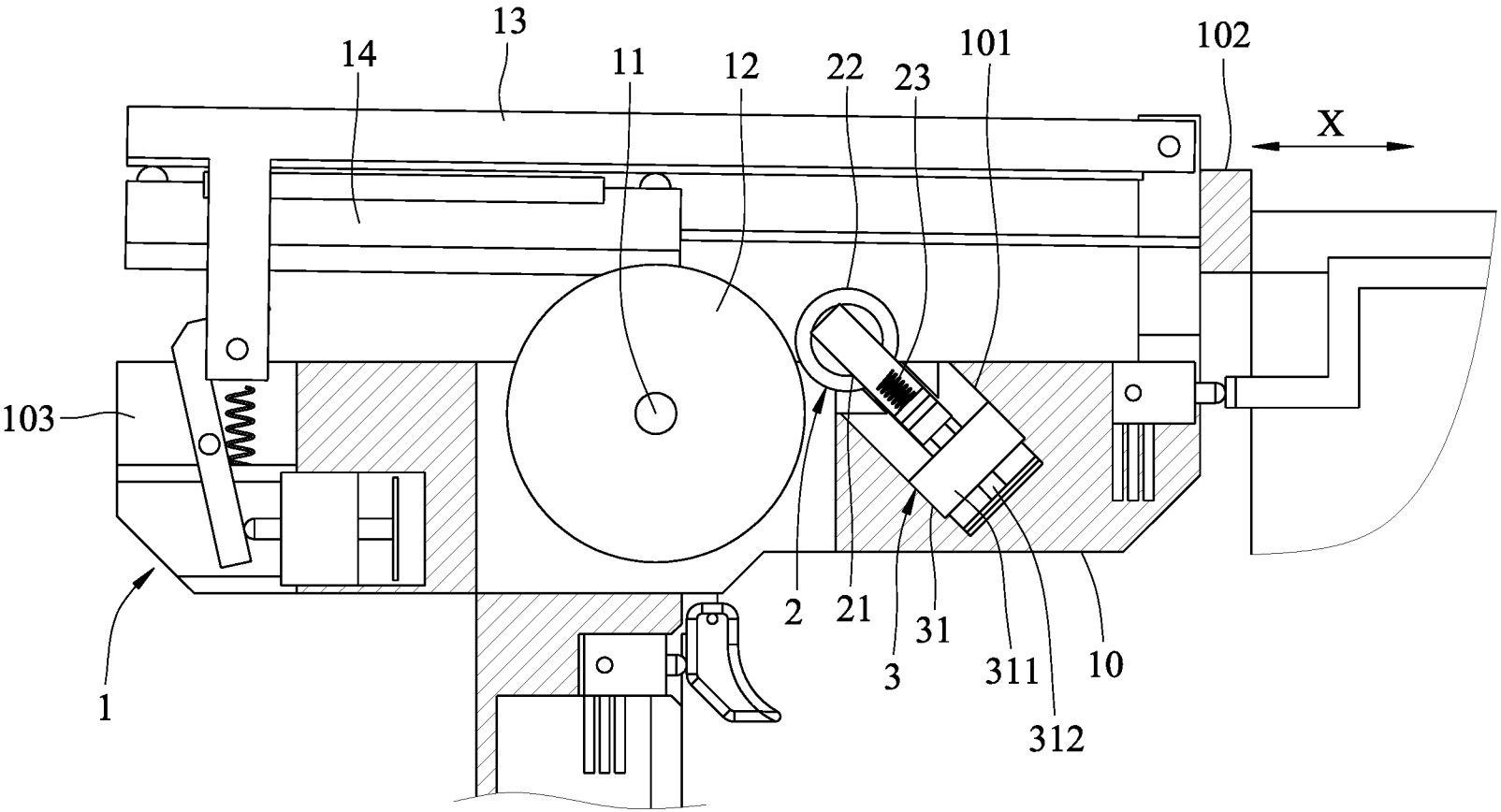
FIG. 4 is a fragmentary and partially sectional side view of the first embodiment, illustrating that a return wheel of the first embodiment is at a free position, and an impact member of the fastening tool is at a standby position.
Figure 12:
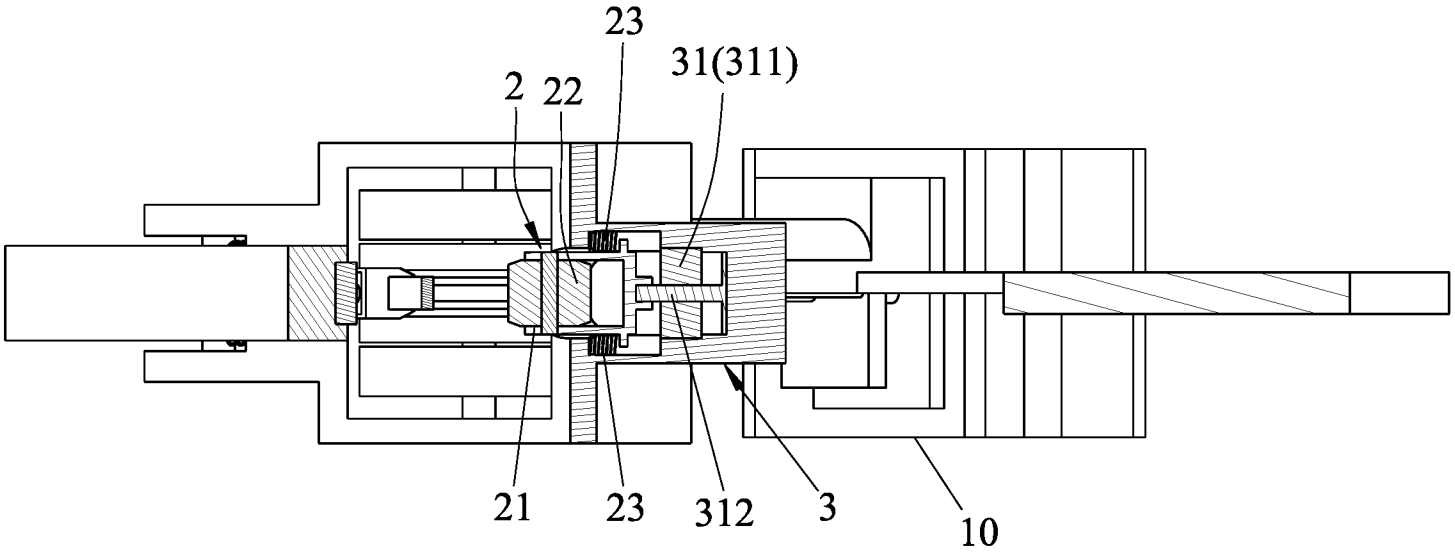
FIG. 12 is a schematic fragmentary sectional view of the first embodiment, illustrating how a resilient member is connected between the wheel support and a gun body.

The return wheel unit 2 is adapted to be mounted to the gun body 10 at a location close to the flywheel 12, and includes a wheel support 21 adapted to be received in the first channel 101 of the gun body 10, a return wheel 22 rotatably mounted to the wheel support 21, and movable between a free position (see FIGS. 4 and 5) and a return position (see FIGS. 6 and 7), and at least one resilient member 23 adapted to be connected between the wheel support 21 and the gun body 10 (see FIG. 12). When the return wheel 22 is at the free position, the return wheel 22 is not in contact with the impact member 14. When the return wheel 22 is at the return position, the impact member 14 is at the strike position and is not in contact with the flywheel 12, and the return wheel 22 is in contact with the flywheel 12 and the impact member 14 such that, when the flywheel 12 rotates in a first rotational direction, the return wheel 22 is driven by the flywheel 12 to rotate in a second rotational direction which is opposite to the first rotational direction, and moves the impact member 14 from the strike position to the standby position. It should be noted that, in this embodiment, the return wheel unit 2 includes two resilient members 23, and the number of the resilient members 23 may be varied in other embodiments. The resilient members 23 are respectively disposed at two opposite sides of the wheel support 21, and are disposed for providing resilient forces to bias the return wheel 22 to move to the free position.

The driving unit 3 is adapted to be mounted to the gun body 10, and drives the movement of the return wheel 22 between the free position and the return position. The driving unit 3 includes a driving member 31 having a main body 311, and a rod member 312 that is movable relative to the main body 311. One of the main body 311 and the rod member 312 is adapted to be fixedly connected to the gun body 10. In this embodiment, the main body 311 is adapted to be fixedly connected to the gun body 10, and the rod member 312 is electrically driven to push the wheel support 21 so as to move the return wheel 22 to the return position.

Figure 5:
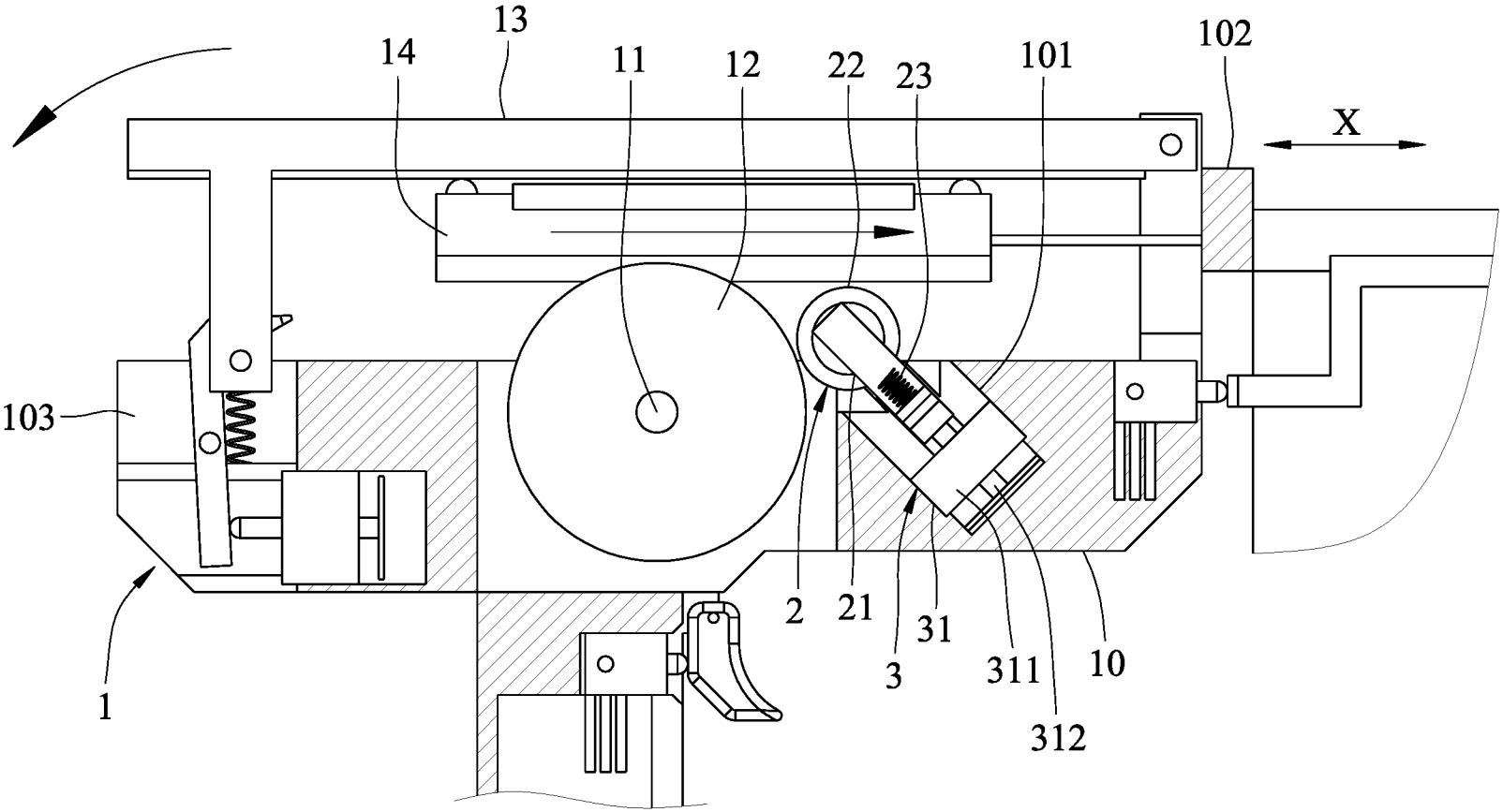
FIG. 5 is a view similar to FIG. 4 but illustrating that the impact member moves from the standby position to a strike position.

As shown in FIG. 5, when the arm 13 pivots toward the flywheel 12 so that the impact member 14 comes into contact with the flywheel 12, the impact member 14 is thrown by the flywheel 12 to move from the standby position (see FIG. 4) to the strike position (see FIG. 6) to complete a nail striking operation. At the same moment, the return wheel 22 remains at the free position, and is not in contact with the flywheel 12.

Figure 6:
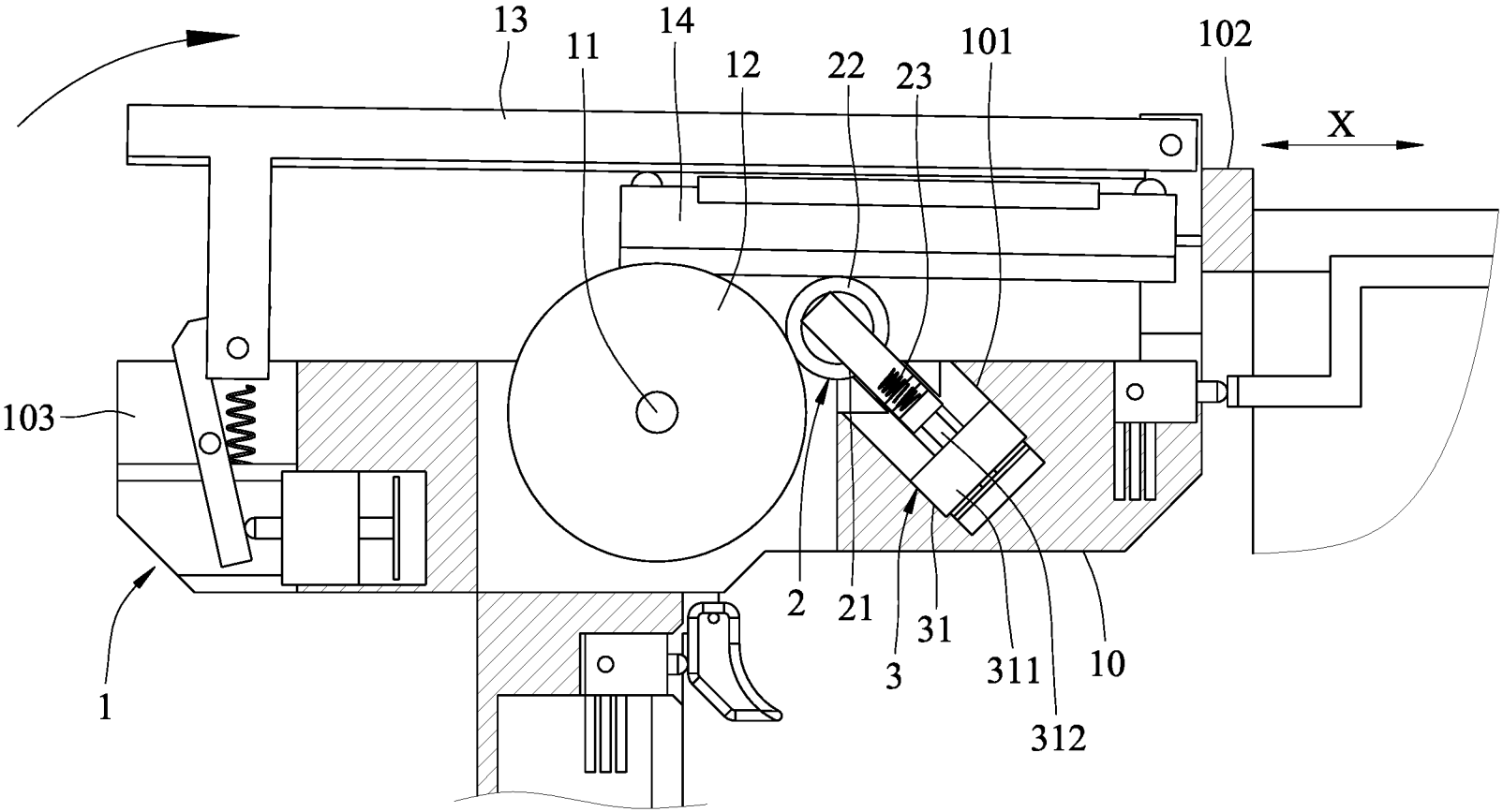
FIG. 6 is a view similar to FIG. 4 but illustrating that the impact member is at the strike position, and the return wheel is at a return position.

As shown in FIG. 6, after the nail striking operation is completed, the arm 13 pivots away from the flywheel 12, such that the impact member 14 is not in contact with the flywheel 12. Meanwhile, the rod member 312 of the driving member 31 is electrically driven to drive the wheel support 21 to overcome the resilient forces of the resilient members 23 so as to move toward the flywheel 12 along the first channel 101. When at the return position, the return wheel 22 is in contact with the flywheel 12 and the impact member 14.

Figure 7:
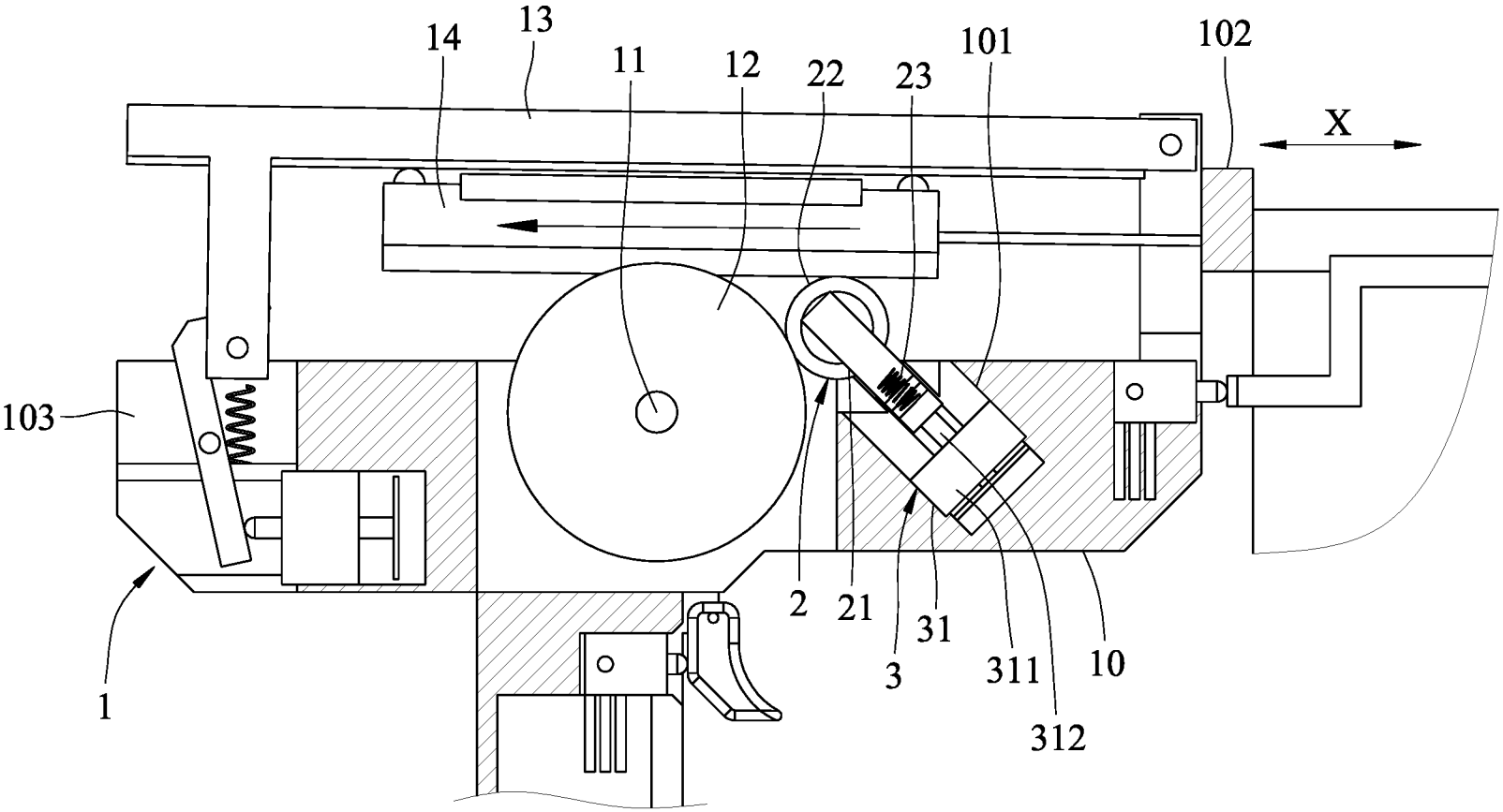
FIG. 7 is a view similar to FIG. 4 but illustrating that the return wheel drives the impact member to move from the strike position to the standby position.

As shown in FIG. 7, since the flywheel 12 continues to rotate in the first rotational direction after the nail striking operation is completed due to inertia or electric re-driving, when the return wheel 22 comes into contact with the flywheel 12, the return wheel 22 is driven by the flywheel 12 to rotate in the second rotational direction. As a result, the impact member 14 is driven by the return wheel 22 to move from the strike position to the standby position to complete a returning operation.

Figure 8:
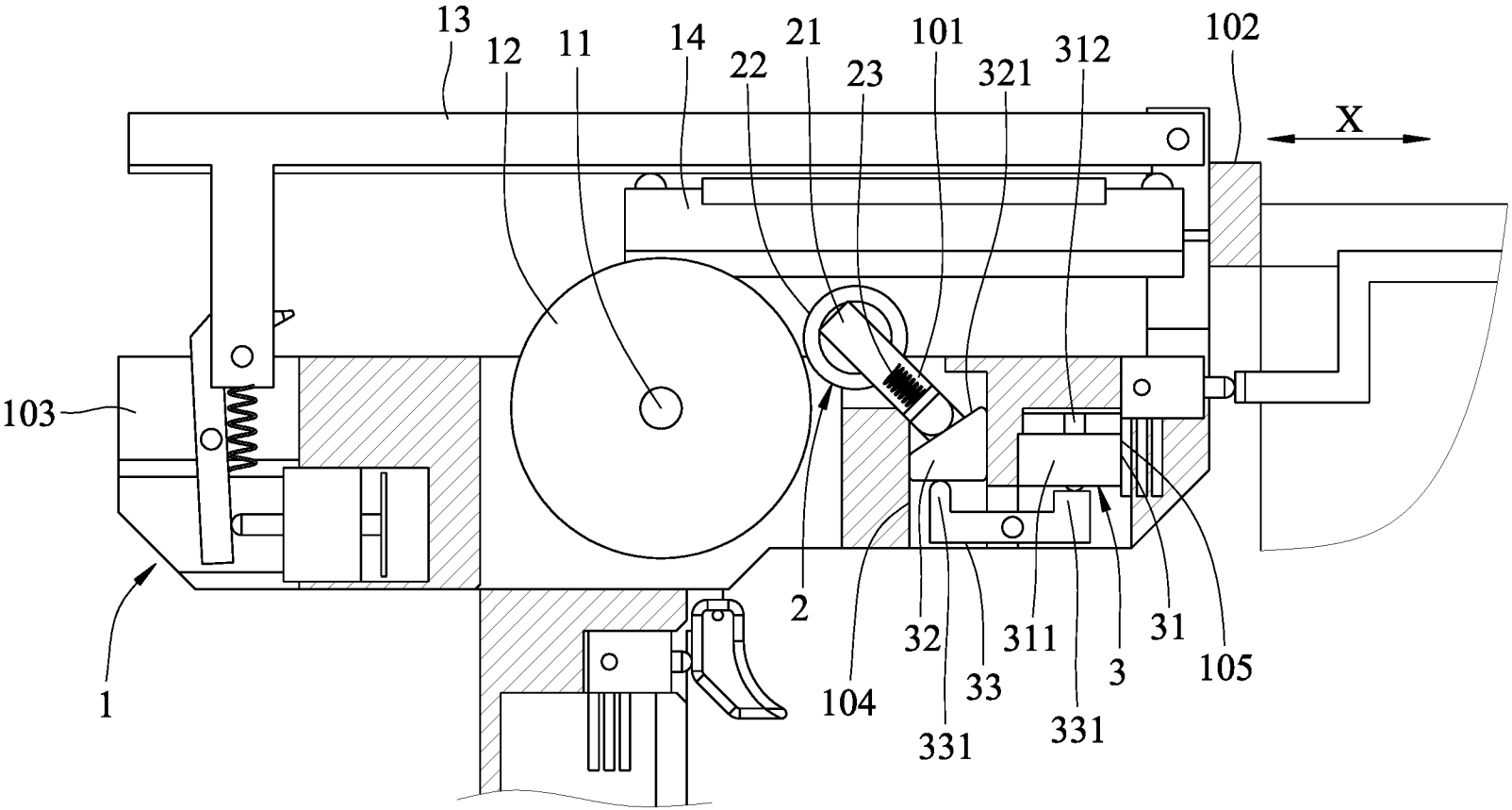
FIG. 8 is a fragmentary and partially sectional side view illustrating a second embodiment of the return device according to the disclosure, illustrating that the second embodiment is adapted to be mounted to a fastening tool, and illustrating that an impact member of the fastening tool is at a strike position and a return wheel of the second embodiment is at a free position.
Figure 9:
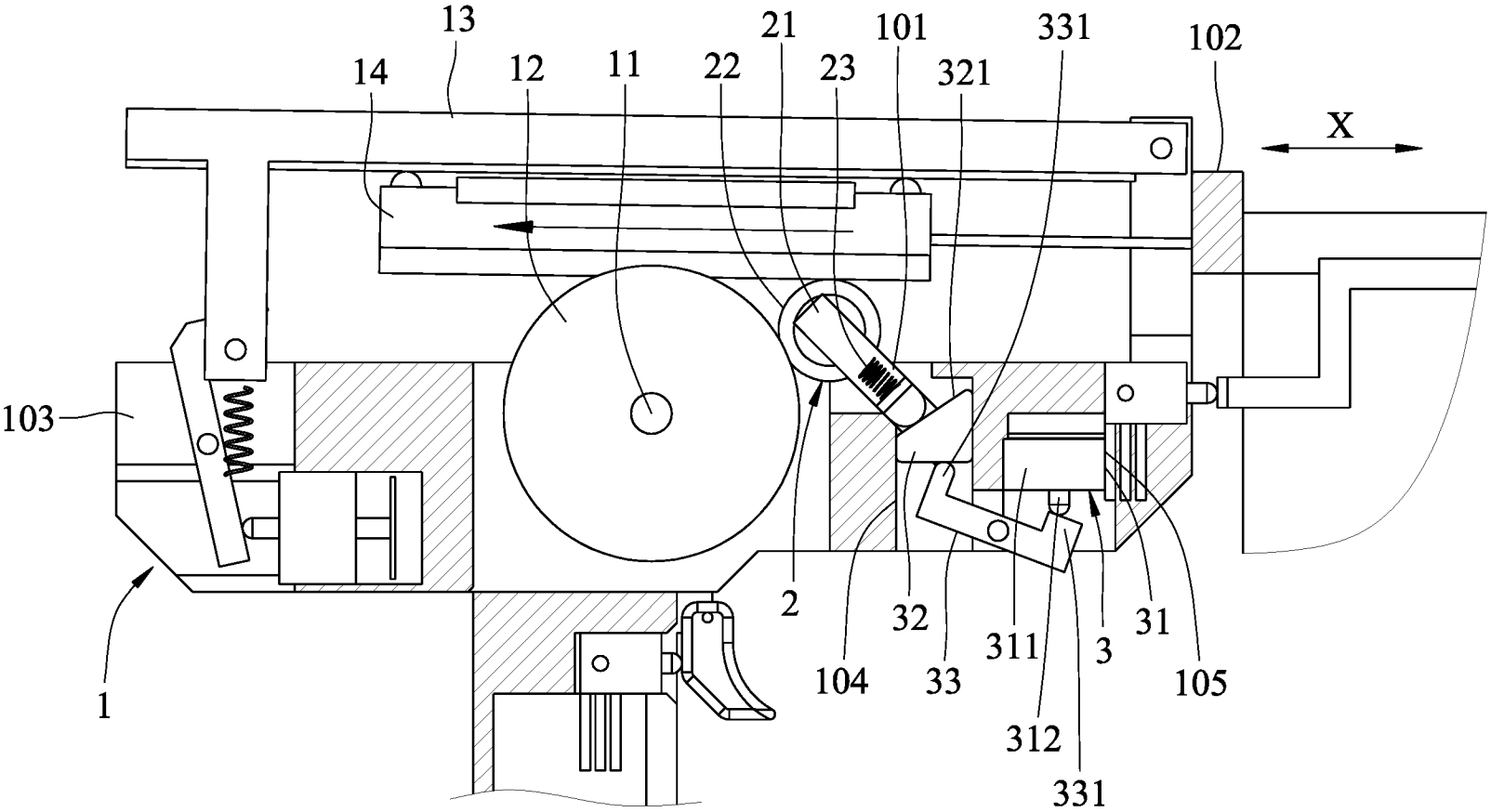
FIG. 9 is a view similar to FIG. 8 but illustrating that the return wheel of the second embodiment is at a return position, and drives the impact member to move from a strike position to a standby position.

Referring to FIGS. 8 and 9, the second embodiment has a structure similar to that of the first embodiment. In this embodiment, the gun body 10 of the fastening tool 1 further has a second channel 104 extending in a driving direction which is perpendicular to the longitudinal direction (X), and communicated with the first channel 101, and a third channel 105 extending parallel to the second channel 104. The main difference between this embodiment and the previous embodiment resides in the configuration of the driving unit 3.

In this embodiment, the driving unit 3 further includes a guiding member 32 adapted to be received in the gun body 10, and a driven member 33. The driving member 31 is adapted to be received in the third channel 105 such that, the rod member 312 is movable relative to the driven member 33 in the driving direction. The guiding member 32 is adapted to be received in the second channel 104, is movable in the driving direction, is mounted between the driven member 33 and the wheel support 21, and has an inclined surface 321 abutting against the wheel support 21, and disposed for pushing the wheel support 21. The driven member 33 is driven by the driving member 31, and has a middle portion adapted to be pivotally connected to the gun body 10, and two end portions 331 respectively abutting against the rod member 312 of the driving member 31 and the guiding member 32.

With such disposition, when the rod member 312 of the driving member 31 is electrically driven to move in the driving direction and pushes a corresponding one of the end portions 331 of the driven member 33, the driven member 33 pivots to push the guiding member 32 with the other one of the end portions 331. The guiding member 32 subsequently moves in the second channel 104 toward the wheel support 21 to drive the wheel support 21 with the inclined surface 321 to move in the first channel 101 against the resilient forces of the resilient members 23. The return wheel 22 is carried by the wheel support 21 to move to the return position, and comes into contact with the flywheel 12 and the impact member 14 so as to drive the impact member 14 to move back to the standby position.

Figure 10:
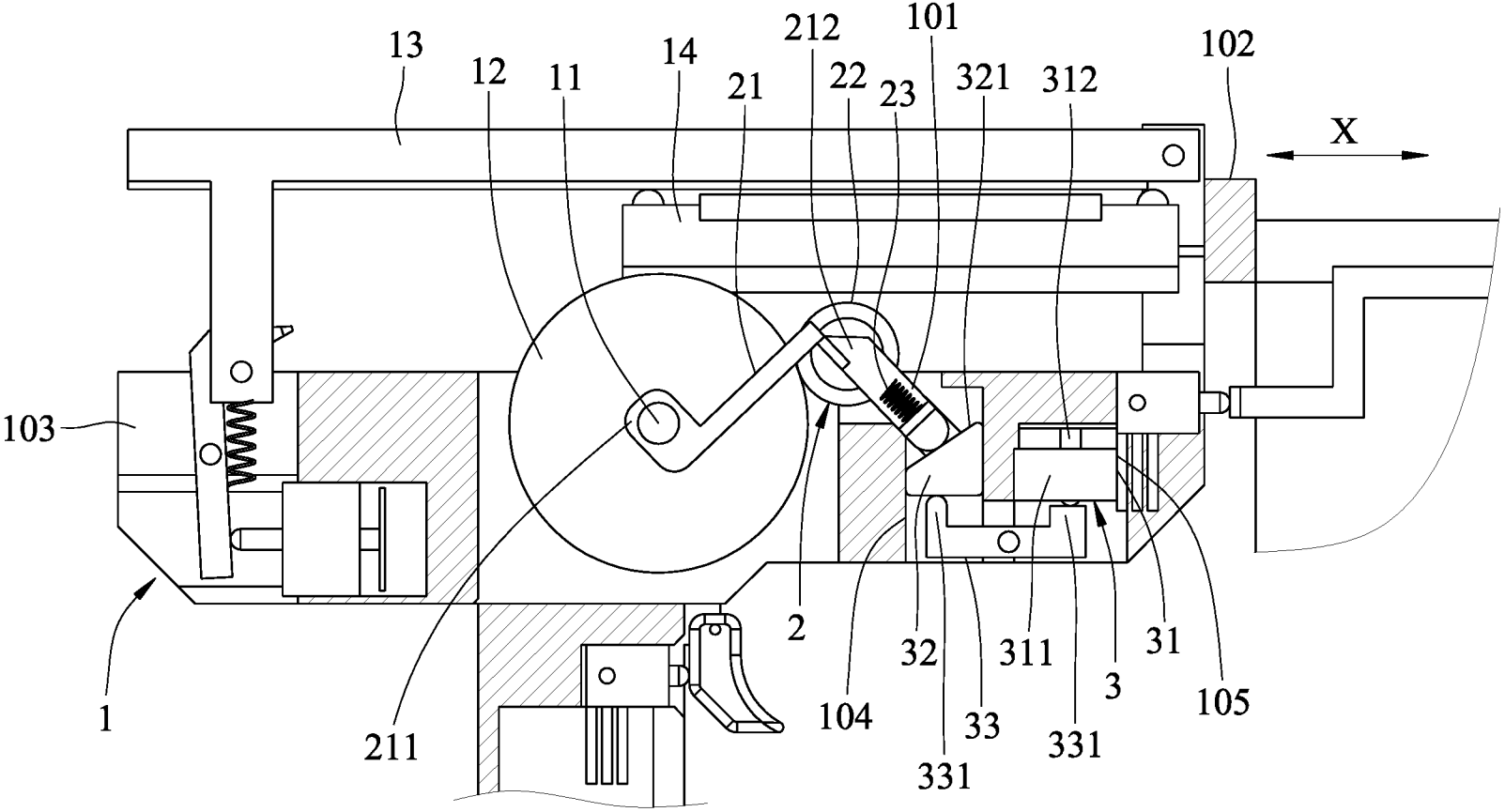
FIG. 10 is a fragmentary and partially sectional side view illustrating a third embodiment of the return device according to the disclosure, illustrating that the third embodiment is adapted to be mounted to a fastening tool, and illustrating that an impact member of the fastening tool is at a strike position and a return wheel of the third embodiment is at a free position.
Figure 11:
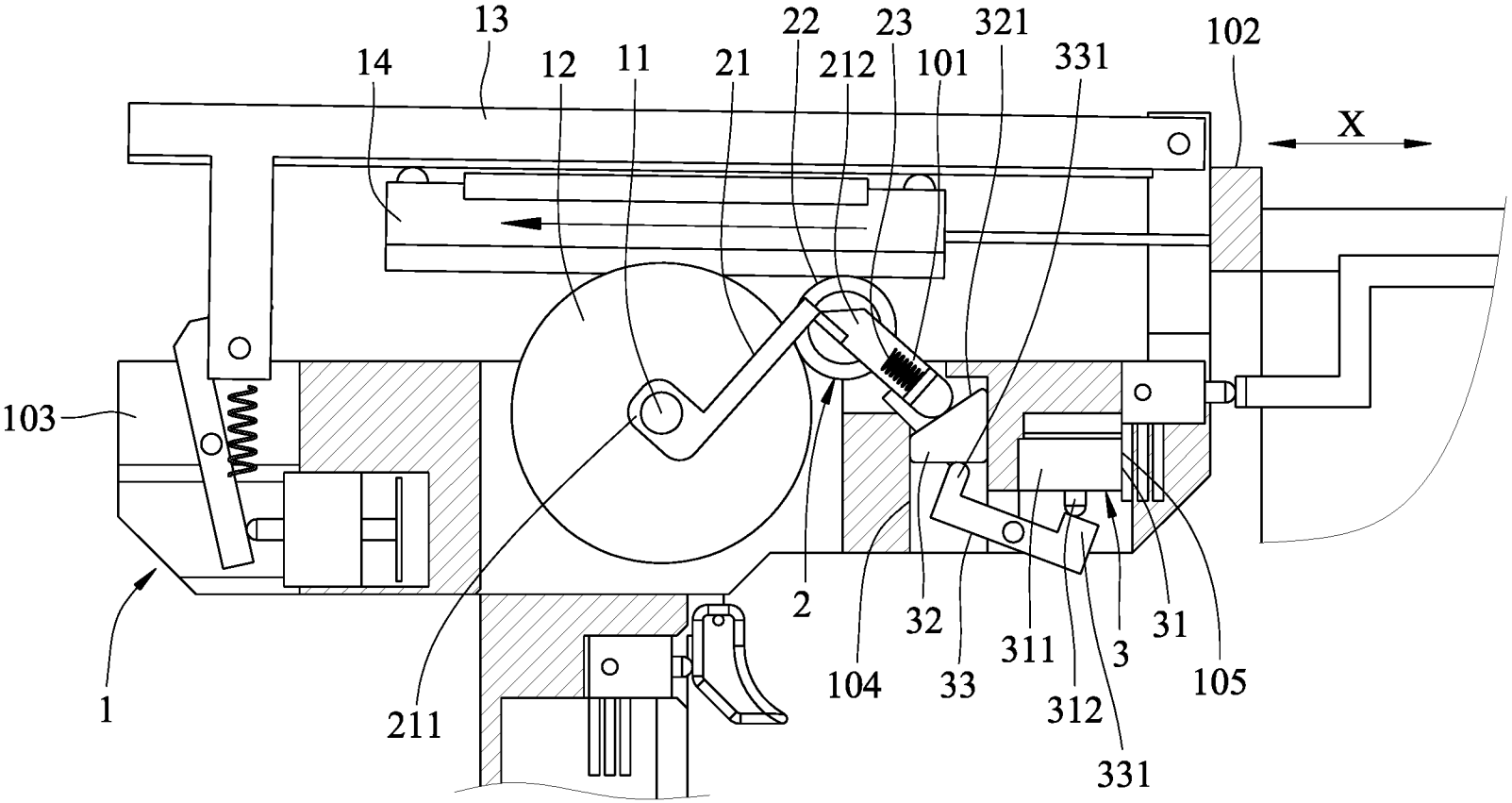
FIG. 11 is a view similar to FIG. 10 but illustrating that the return wheel of the third embodiment is at a return position, and drives the impact member to move from a strike position to a standby position.

Referring to FIGS. 10 and 11, the third embodiment has a structure similar to that of the second embodiment. The main difference between this embodiment and the previous embodiment resides in the configuration of the return wheel unit 2. In this embodiment, the wheel support 21 has two pivot portions 211 adapted to be pivotally and respectively connected to two opposite ends of the central shaft 11, and a frame portion 212 connected to the pivot portions 211, movable in the first channel 101, disposed for allowing the return wheel 22 to be rotatably mounted thereto, and driven by the driving unit 3.

With such disposition, when the return wheel 22 is at the free position, the flywheel 12 is in rollable contact with the return wheel 22 and rotates in the first rotational direction, and the return wheel 22 is driven by the flywheel 12 to rotate in the second rotational direction. When the rod member 312 of the driving member is electrically driven to move in the driving direction and pushes a corresponding one of the end portions 331 of the driven member 33, the driven member 33 pivots to push the guiding member 32 with the other one of the end portions 331. The guiding member 32 subsequently moves in the second channel 104 toward the frame portion 212 of the wheel support 21 to drive the frame portion 212 of the wheel support 21 with the inclined surface 321 to move in the first channel 101 against the resilient forces of the resilient members 23. The return wheel 22 is carried by the wheel support 21 to move to the return position so as to drive the impact member 14 to move back to the standby position. It should be noted that, since the pivot portions 211 swing slightly when the return wheel 22 moves from the free position to the return position to allow smooth movement of the frame portion 212 in the first channel 101, the return wheel 22 can move along an outer periphery of the flywheel 12. As such, the slight angular movement of the pivot portions 212 is compensated for by the deformations of the resilient members 23, and the moving smoothness of the frame portion 212 of the wheel support 21 in the first channel 101 is not affected.

In conclusion, with the abovementioned configuration, the return device of the disclosure has the following advantages:

The return wheel 22 is kept spaced apart from the impact member 14 and does not apply a resistance to the impact member 14 during the nail striking operation. As a result, the smoothness and the output kinetic energy of the nail striking operation are greatly increased.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A return device adapted for use in a fastening tool, the fastening tool including a gun body, an electrically rotatable flywheel that is mounted rotatably to the gun body, and an impact member that is contactable with the flywheel, and that is movable between a standby position, where the impact member is close to a rear end portion of the gun body, and a strike position, where the impact member is close to a front end portion of the gun body, said return device comprising:

a return wheel unit adapted to be mounted to the gun body, and including a return wheel that is movable between a free position, where said return wheel is not in contact with the impact member, and a return position, where the impact member is at the strike position and is in not contact with the flywheel, and where the return wheel is in contact with the flywheel and the impact member such that, when the flywheel rotates in a first rotational direction, the return wheel is driven by the flywheel to rotate in a second rotational direction which is opposite to the first rotational direction, and moves the impact member from the strike position to the standby position; and a driving unit adapted to be mounted to the gun body, and driving the movement of said return wheel between the free position and the return position.

2. The return device as claimed in claim 1, wherein when said return wheel is at the free position, the flywheel is in rollable contact with said return wheel and rotates in the first rotational direction, and said return wheel is driven by the flywheel to rotate in the second rotational direction.

3. The return device as claimed in claim 1, wherein said return wheel unit further includes a wheel support adapted to be movably mounted to the gun body, said return wheel being rotatably mounted to said wheel support.

4. The return device as claimed in claim 3, wherein said return wheel unit further includes at least one resilient member adapted to be connected between said wheel support and the gun body, and disposed for providing a resilient force to bias said return wheel to move to the free position.

5. The return device as claimed in claim 3, the fastening tool further including a central shaft disposed for allowing the flywheel to be rotatably mounted thereto, wherein said wheel support has two pivot portions adapted to be pivotally and respectively connected to two opposite ends of the central shaft, and a frame portion connected to said pivot portions, disposed for allowing said return wheel to be rotatably mounted thereto, and movably driven by said driving unit.

6. The return device as claimed in claim 3, wherein said driving unit includes a driving member having a main body, and a rod member that is movable relative to said main body, one of said main body and said rod member being adapted to be fixedly connected to the gun body.

7. The return device as claimed in claim 6, wherein said rod member of said driving unit is electrically driven to push said wheel support so as to move said return wheel to the return position.

8. The return device as claimed in claim 6, wherein said driving unit further includes a driven member adapted to be pivotally connected to the gun body, and driven by said driving member to move said wheel support.

9. The return device as claimed in claim 8, wherein:

said driving unit further includes a guiding member adapted to be received in the gun body, mounted between said driven member and said wheel support, and movable in a driving direction which is perpendicular to the longitudinal direction;

said driven member has a middle portion adapted to be pivotally connected to the gun body, and two end portions respectively abutting against said rod member of said driving member and said guiding member; and said guiding member has an inclined surface abutting against said wheel support such that, when said rod member of said driving member moves in the driving direction to push a corresponding one of said end portions of said driven member, said driven member pivots so that the other one of said end portions pushes said guiding member to move said wheel support.

* * * * *